United States Patent [19]

Manderfeld et al.

[11] Patent Number: 5,009,411

[45] Date of Patent: Apr. 23, 1991

[54] INPUT HOPPER APPARATUS

[75] Inventors: Donald J. Manderfeld, Richfield; Robert A. Sells, Minneapolis, both of Minn.

[73] Assignee: DataCard Corporation, Minneapolis, Minn.

[21] Appl. No.: 237,214

[22] Filed: Aug. 26, 1988

[51] Int. Cl.[5] ..... B65H 1/08

[52] U.S. Cl. ..... 271/129; 271/136; 271/139; 271/143

[58] Field of Search ..... 271/119, 126, 120, 128, 271/129, 131, 136, 139, 143, 274, 149, 160, 114, 118, 265, 266; 414/796.8, 797.3, 797.7, 797.9; 74/582, 470, 599, 66, 68, 69

[56] References Cited

U.S. PATENT DOCUMENTS

| | | | |
|---|---|---|---|
| 75,051 | 3/1868 | Pierce | 74/532 |
| 1,491,869 | 4/1924 | Kusterer | 271/139 |
| 1,959,854 | 5/1934 | Cameron . | |
| 2,124,223 | 7/1938 | Zaengle . | |
| 2,510,559 | 6/1950 | Daly . | |
| 2,605,102 | 7/1952 | Mixer . | |
| 2,680,510 | 6/1954 | Donath | 414/797.7 X |
| 3,002,750 | 10/1961 | Wheeler . | |
| 3,007,696 | 11/1961 | Wheeler et al. . | |
| 3,031,188 | 4/1962 | Grosnickle, Jr. et al. . | |
| 3,133,674 | 5/1964 | Schmaus . | |
| 3,240,489 | 3/1966 | Pinckney et al. . | |
| 3,642,271 | 2/1972 | Davis . | |
| 3,825,248 | 7/1974 | Friend | 271/10 |
| 3,961,785 | 6/1976 | Gall | 271/119 |
| 4,268,021 | 5/1981 | Rutishauser et al. | 271/4 |
| 4,302,000 | 11/1981 | Frank | 271/150 |
| 4,406,447 | 9/1983 | Fichte et al. | 271/31 |
| 4,519,600 | 5/1985 | Warwick et al. | 271/4 |
| 4,551,982 | 11/1985 | Kocher et al. | 74/470 |
| 4,660,822 | 4/1987 | Winkler et al. | 271/114 X |

*Primary Examiner*—David H. Bollinger

*Attorney, Agent, or Firm*—Merchant, Gould, Smith, Edell, Welter & Schmidt

[57] ABSTRACT

An input hopper (20) for inputting card members to card processing modules (14) includes a tray (22) for storing the cards which are maintained in a stack by a pusher mechanism (30) having a plate (23) biasing the card stack toward a first end of the tray (22). A notched cam (42) at the first end of the tray (22) rotates and engages the edge of a lead card to separate it from the stack. Rollers (50,52,54) engage the separated card and deliver the card from the input hopper (20). The cam (42) and main roller (50) are driven by a motor (60) and drive linkage (61) including a coiled spring (70) to provide an override to the drive linkage (61) in the event of jamming.

2 Claims, 4 Drawing Sheets

INPUT HOPPER APPARATUS

BACKGROUND OF THE INVENTION

1. Field of the Invention

This invention relates to an input hopper which transfers cards and the like from a stack into a module for processing.

2. Description of the Prior Art

Sheet and card feeding mechanisms are in wide spread use. There are many systems requiring the input of sheets or cards. The systems separate a card from a stack of cards and feed the card into the system. A major problem associated with card feeders is that a card often jams or sticks. This may cause damage to the system and costly downtime. Numerous devices to circumvent the problem of a jammed or sticky card have been disclosed.

Earlier methods included various ways to prevent further feeding of cards once a jam was located downstream. U.S. Pat. No. 1,959,854, 2,510,559 and 3,002,750 are representative of this. However, a problem associated with this approach is that many cards or sheets may be fed to cause the jam, thus causing considerable downtime in clearing the jam. The jam also has the potential to cause considerable damage to the machine, sheets or cards.

Another approach taken in U.S. Pat. No. 4,302,000 is to decrease or increase the force applied to the stack and thus diminish the possibility of a jam. This is only acceptable for compressible stacks such as paper and even then is not a fool proof method to deal with jams.

The wide spread use and manufacturing of cards today have put high demand on an efficient input hopper system. The high speed input hoppers of today have introduced problems associated with the input of cards which have not been addressed in the prior art. Stacks of blank cards are commonly made by punching a prescribed shape through a stack comprising many sheets of plastic. The resultant stack of cards often contain burrs on the edges. The burrs tend to interlock amongst themselves thereby making it difficult for a single card to be removed from the stack. Thus it is critical that the input hopper system for these cards be able to sense when a card is stuck and shut down before damage occurs.

There are numerous embossing machines on the market today which utilize an input hopper system for plastic credit cards. U.S. Pat. No. 4,384,711 utilizes an input hopper system with a positioning cam. The cam comprises a card shelf moving vertically in a two dimensional plane. The shelf engages a bottom edge of a single card from a stack and pushes the card in a shearing direction away from the stack. The shelf or drive mechanism may become damaged when the required shear force becomes too great, thus the system has been modified by adding a spring which extends when the force to push the card is greater than the force of the spring. This spring prevents the card picking mechanism from damaging itself when a card requires a shear force greater than the strength of mechanism components.

DataCard model 4000 is an embossing system that utilizes card picker shafts to shear a card from a stack of cards. Each shaft comprises a vertically moving pronged element interconnected to a spring in a fashion similar to U.S. Pat. No. 4,384,711. The pronged picker moves in a two-dimensional field and shears a card from the bottom in an upwardly fashion. However, the picker does not always successfully shear both ends of the card from the stack, and may leave one side up and one side down. As a result, the card does not successfully leave the input hopper system and temporarily halts the system. A further problem with the 4000 system is that the linear drive motion is more costly than a rotary drive motion. The linear system is bulky in that a drive shaft must extend in the vertical direction as well as the horizontal direction.

U.S. Pat. No. 4,519,600 utilizes an input hopper system which at first glance appears somewhat similar to the present invention in that a motor drives a pulley which is linked through a series of belts and shafts to a picker cam and a roller assembly. However, in addition to other differences, when a card is stuck to the rest of the stack, the force required to free the card from the stack often exceeds the force of the clamping screw on the output arm or the set screw on the picker cam. The picker cam shaft may then become misaligned, thus requiring the hopper assembly to be serviced. This results in lengthy and costly downtime for the input hopper.

It is, therefore, evident that there is a need for a low maintenance input hopper system. Large embossing systems emboss large quantities of cards and any downtime results in substantial repair costs and reduced card production. The present invention provides an input hopper system which reduces downtime and costly repairs and provides high speed input of cards into the embossing system.

SUMMARY OF THE INVENTION

The present invention relates to an input hopper system for the input of cards and the like. In particular, the input hopper may be used in an embossing system for cards. The input hopper system comprises a stacking means having a front and rear end for storing the card members in a stacked configuration. The card members have two opposing major surfaces and a top, a bottom, a first and a second side edge. The card members are resting on their bottom edges when they are stored in the stacking means. The stacking means has a card pusher or biasing means which biases the card members toward the front end of the stacking means. A card picker means comprising a motor and drive linkage separates a lead card member from the remaining card member stack. The drive linkage includes a compression spring for disengaging the card picker means from the motor when a force greater than the compression force of the spring is exerted by the linkage. In one embodiment, the biasing means may be fixably positioned in such a manner as to allow for the insertion of a large number of stacked cards. As the card members leave the input hopper system, the biasing means slidably positions itself closer to the front end of the stacking means.

In one embodiment, the motor drives a pulley system comprising a pulley, a belt, an eccentrically positioned shaft, and a photocell flag. As the pulley rotates, the eccentrically positioned coupler shaft is pushed or pulled in the direction of rotation against an extension arm through a coupler link which in turn rotates a picker cam. The picker cam is disk-shaped with a notched edge located on the periphery of it. As the picker cam rotates, the notched edge accommodates the rear edge of the leading card member of the stack, thereby shearing the lead card member away from the stack. A coaxially placed spring is disposed around the coupler shaft. When a force greater than the compressive force of the spring is exceeded, the spring will compress. When the spring compresses, the coupler shaft slips through the extension arm, thereby disengaging the rotation of the picker cam. In this manner, the assembly does not damage itself or become misaligned when a card is stuck to the stack.

In one embodiment, the card picker means also has an assembly of rollers driven by a belt which in turn is driven by the pulley. The roller assembly acts in conjunction with the picker cam and aids in shearing the lead card from the card stack after the picker cam has initiated movement of the card. The roller assembly utilizes a main roller and a spring biased pinch roller to grip the card and remove it from the input hopper assembly.

In one embodiment, the photocell flag is also attached to the pulley. The purpose of the photocell flag is to provide angular position information for motor control purposes. A photocell senses when the photocell flag has made a revolution, thus signaling a controller which shuts the motor off.

In addition to other features and advantages, the present invention provides a system where the input of cards is time efficient. The cards may be processed at high speeds with minimal downtime. When a card remains stuck to the remaining stack of cards, the user is alerted before any damage has occurred.

These and various other advantages and features of novelty which characterize the present invention are pointed out with particularity in the claims annexed hereto and forming a further part hereof. However, for a better understanding of the invention, its advantages and objects obtained by its use, reference should be made to the drawings which form a further part hereof, into the accompanying descriptive manner, in which there is illustrated and described a preferred embodiment of the present invention.

BRIEF DESCRIPTION OF THE DRAWINGS

In the drawings wherein like reference numerals and letters indicate corresponding elements throughout the several views.

DETAILED DESCRIPTION OF THE PREFERRED EMBODIMENT

Figure 1:
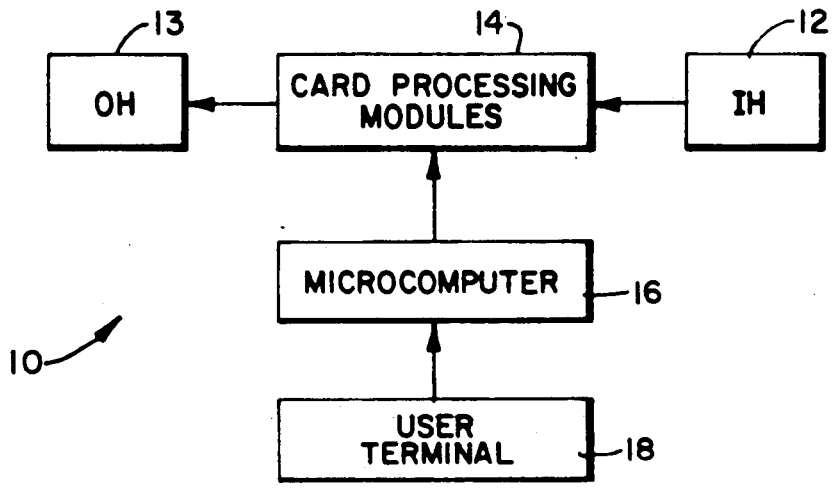
FIG. 1 is a block diagram illustrating a card processing system with an embodiment of an input hopper apparatus in accordance with the principles of the present invention.

Referring now to FIG. 1, there is illustrated a block diagram of a card processing system, generally referred to by the reference numeral 10 including an input hopper 12. The input hopper 12 is illustrated in conjunction with card processing modules 14 and an output hopper 13, comprising the card processing system 10. The card processing modules may serve many functions including embossing, applying graphics, thermal printing, topping, programming cards having integrated circuits (smart cards), and encoding a magnetic strip of a card, etc. The system could encompass virtually any card processing system 10. A microcomputer 16 and terminal 18 are typically present so as to enable a user to program and access the apparatus 10.

Figure 2:
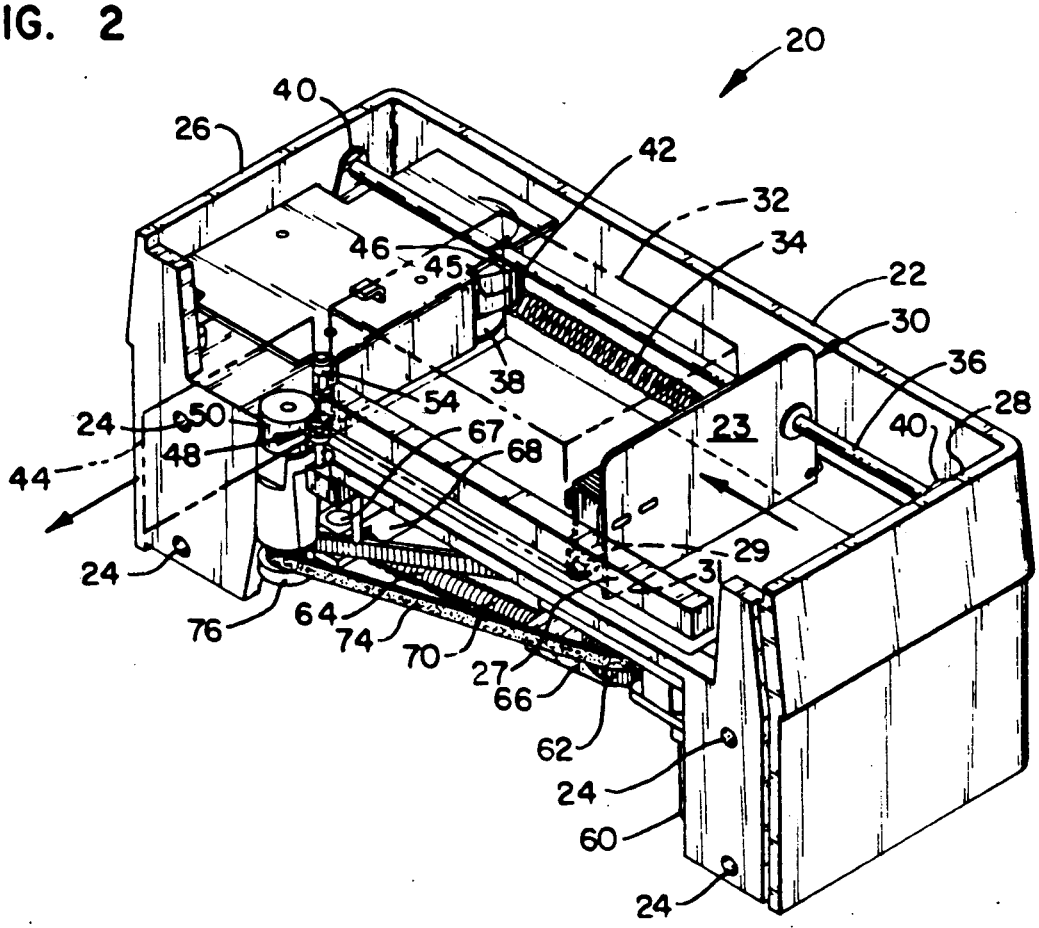
FIG. 2 is a perspective view of an embodiment of an input hopper apparatus in accordance with the principles of the present invention.

FIG. 2 illustrates an embodiment of an input hopper assembly 20, in accordance with the present invention, having a tray housing 22. The tray housing 22 may be suitably secured to a frame structure of the processing system 10 via annular spaces 24 using bolts or other fastening means. The tray housing 22 has a front end 26 and a rear end 28. The input hopper assembly 20 has a card pusher mechanism 30. The card pusher mechanism 30 performs a function of maintaining card members 32 (shown in silhouette) in a stacked configuration, often referred to as a stack of cards and moving the card members 32 toward the front end 26. Card members 32 may be plastic, paper, metal, or other materials used in the manufacturing of cards. The card pusher mechanism 30 is biased by a coiled spring 34. The coiled spring 34 may be substituted by any elastic material useful as a biasing device or even other biasing devices. The card pusher mechanism 30 is guided by a guide rail 36 and a guide bar 27. The guide bar 27 is disposed along a side of the card stacks opposite the guide rail 36. The plate 23 of the card pusher mechanism 30 includes a projection 29 which slides under the bar guide 27 to prevent rotation of the plate 23. The guide rail 36 and the guide bar 27 also serve to guide the stack of cards 32. The guide bar 27 extends to the card adjacent the lead card of the stacks of the front end of the hopper apparatus 20 such that it prevents this card and the other cards from being fed from the hopper when the lead card is fed from the hopper. As cards are pulled from the front end of the card stack 32, a plate 23 of the card pusher mechanism slides along the guide rail 36. The coiled spring 34 rotates around pulley 38 in a slidable fashion as the card pusher mechanism 30 moves. To aid the user in loading cards, card pusher mechanism 30 may be secured in an open position such that a stack of cards may be loaded without having to manually hold card pusher mechanism 30. As shown in FIG. 2, a projection 31 may be used to secure the plate 23 of the card pusher mechanism 30 in an open position by insertion into a space in the tray 22.

The hopper assembly may also be adjusted for varying card widths. The rail 36 is supported by brackets 40. The brackets 40 may be adjusted laterally such that rail 36 moves laterally to adjust for a different card width.

Figure 3:
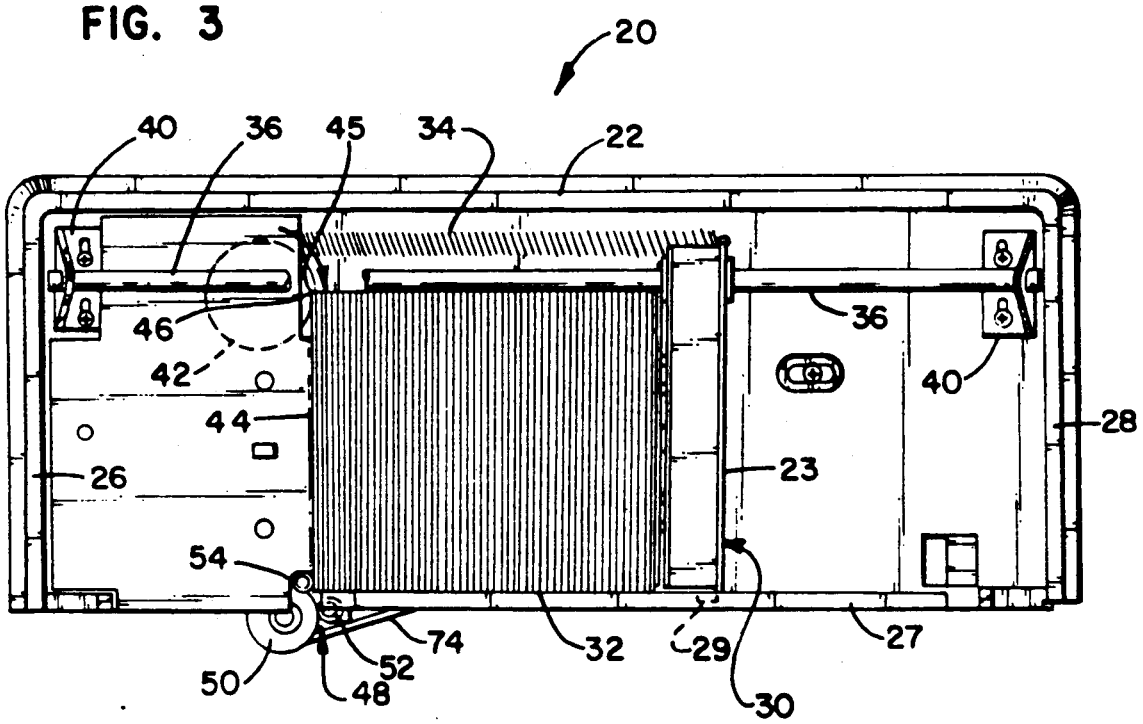
FIG. 3 is a top plan view of the input hopper apparatus shown in FIG. 2 in its normal rest position prior to feeding a card.
Figure 4:
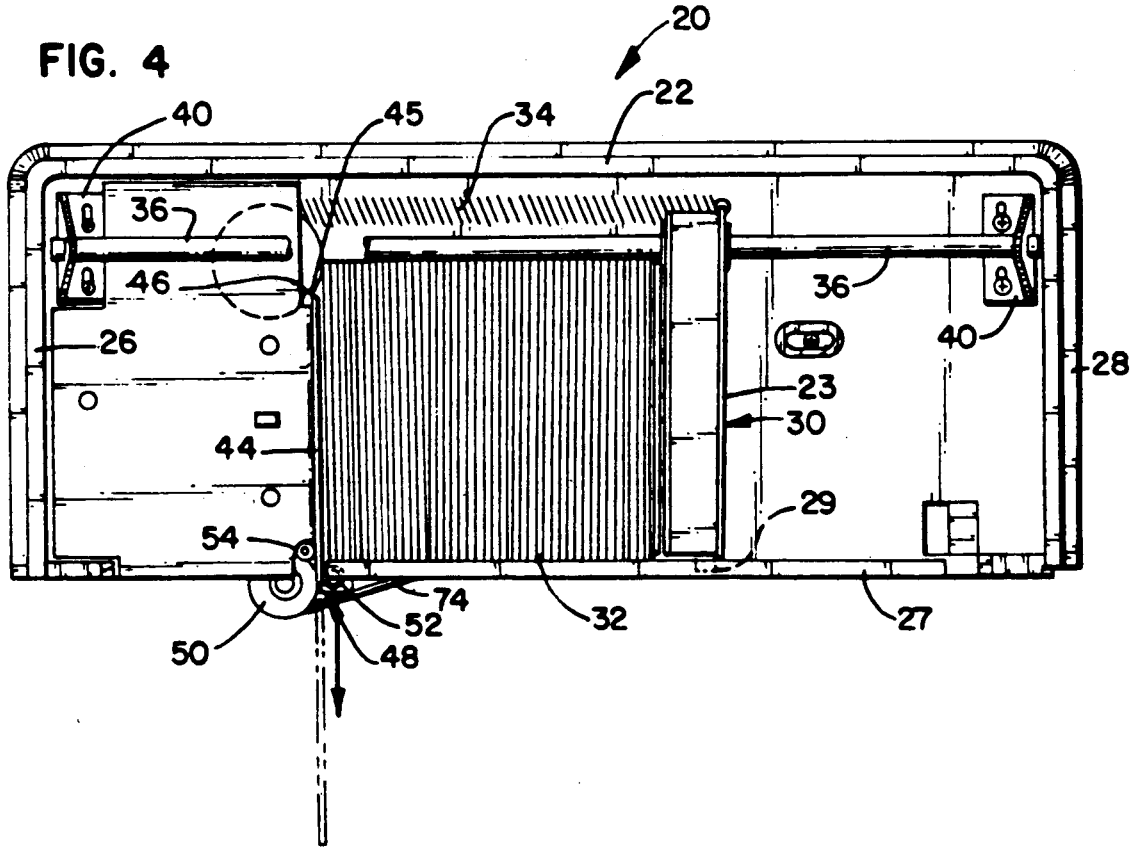
FIG. 4 is a top plan view of the input hopper apparatus shown in FIG. 2 feeding a card from the input hopper.
Figure 5:
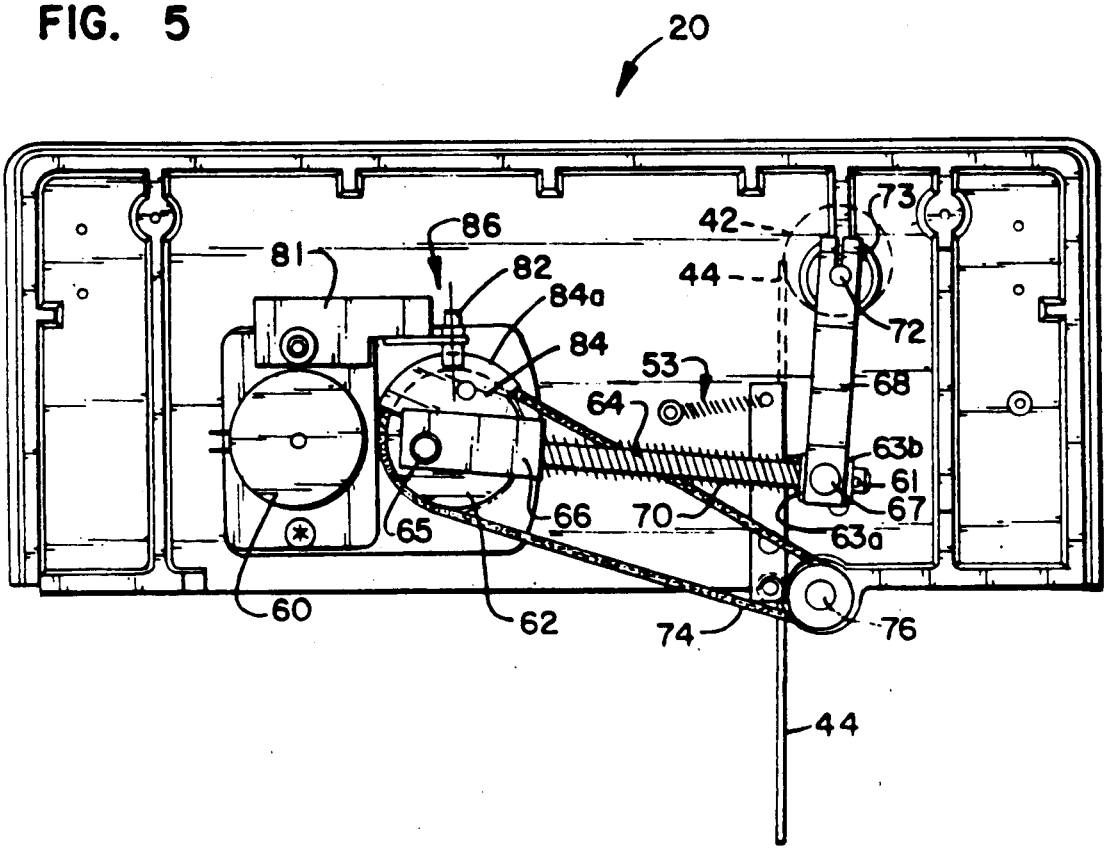
FIG. 5 is a bottom plan view of the bottom of the input hopper apparatus in its rest position as shown in FIG. 3.

FIGS. 3 and 4 illustrate a cam 42 acting as a card picker mechanism propelling a card member 44 away from the card stack 32 and out of the input hopper assembly 20. FIG. 3 illustrates the lead card 44 being engaged by an edge 45 of a notch 46 in the periphery of the cam 42. The cam notch 46 is formed as an indentation into the periphery of the cam 42. The notch 46 defines the edge 45 which engages an edge of card member 44 when the cam 42 rotates with its periphery in contact with the edge of the card member 44. As card member 44 is engaged, it is sheared from the card stack 32 into a roller assembly 48. Roller assembly 48 comprises a main roller 50, a spring biased pinch roller 52 and an index roller 54. The main roller 50 exerts a further shear force to the card 44 as the card is delivered from the cam 42 so as to facilitate removal of the card from the input hopper assembly 20. The pinch roller serves to pinch card 44 against the main roller 50. In the embodiment shown, the pinch roller 52 is spring loaded by a spring arrangement 53 as shown in FIG. 5 and will apply a force of about 2.6 pounds to a card thus keeping the card 44 in contact with the main roller 50. In alternative embodiments, the pinch roller 52 might not be spring biased.

FIG. 5 illustrates a motor 60 and drive linkage system 61 of the input hopper assembly. The motor 60 and the drive linkage 61 are located below the base of the tray 22 in the embodiment shown. The motor 60 drives a timing pulley 62. The pulley 62, in turn, serves three functions. The first function is to drive the cam 42 (see FIGS. 2–4). This is accomplished by an elongated shaft 64 secured to a coupler block 66 and pivotally interconnected by member 67 to an extension arm 68. The coupler block 66 is pivotally attached by a connector 65 in an eccentric manner to pulley 62. A coiled spring 70 is coaxially and slidably fitted upon shaft 64 between the coupler block 66 and the extension arm 68. Spring 70 must be of sufficient length to abut against the coupler block 66 and the extension arm 68. A spring constant of the preferred embodiment is about 0.76 pounds per inch, but this may be varied to accommodate different systems. The extension arm 68 is secured to a cam drive shaft 72 by a clamping screw 73 which clamps together a forked end of the extension arm 68. The cam drive shaft 72 extends upward through the base of the tray 22 and is fixably attached to the cam 42. As the motor 60 rotates the pulley 62, the coupler block 66 moves the shaft 64 and the spring 70 in the direction of the eccentric movement of the coupler block 66 on the pulley 62. The spring 70 causes the extension arm 68 to move thus rotating the cam drive shaft 72 and the cam 42. In addition to being pivotally interconnected to the extension arm 68, the shaft 64 is also slidably interconnected to extension arm 68 by the member 67 which has an aperture therethrough (not shown) for slidable receipt of the shaft 64 such that the shaft 64 does not exert any significant force on the extension arm 68. Washer **63*a* provides a bearing surface for the end of the compression spring 70 and washer 63*b* provides a bearing surface for a pin 61 which retains the elongated shaft 64** in place.

Figure 6:
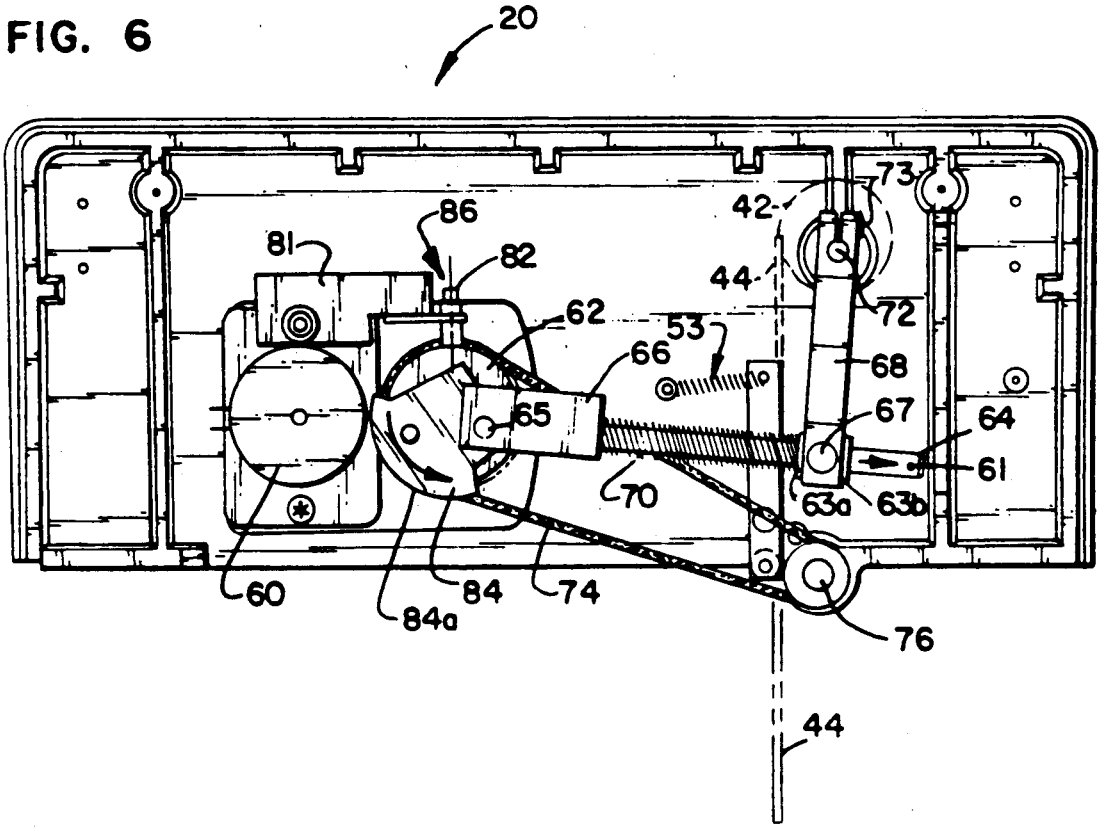
FIG. 6 is a bottom plan view of the bottom of the input hopper apparatus when excessive force has been exerted on the picker cam such as when a card is jammed.

As can be seen from FIG. 6, when the pulley 62 provides a rotational force stronger than the compressive force of the coiled spring 70, the coiled spring 70 compresses and the shaft 64 slides beyond the extension arm 68, thus stalling the movement of extension arm 68. When the extension arm 68 is stalled, the drive shaft 72 does not rotate and the cam 42 will no longer turn. This occurs when the shear force required to separate the lead card 44 from the remaining stack 32 exceeds a predetermined limit. When stacks of cards are cut out of sheets, burrs often occur on the edges of the card. These burrs interlock amongst each other, making it difficult for one card to be separated from the next. Forces up to 50 pounds have been observed in order to shear a card from the stack. When such a high force is exerted on a drive linkage system, damage may occur such as the picker drive linkage becoming misaligned and applying undue stress upon other components of the system. The coiled spring 70 alleviates this problem by absorbing any excess force over a predetermined force limit. The shear force override means provides a safe alternative to an otherwise vulnerable linkage system which may be damaged or misaligned by interlocked cards.

The second function of pulley 62 is to drive the main roller 50. A belt 74 driven by the pulley 62 frictionally rotates a drive shaft 76 of the main roller 50. The roller drive shaft 76 is secured to roller 50 and thus provides rotational force thereto. As the lead card 44 is being sheared from the stack by the cam 42, main roller frictionally engages card member 44 and propels the card 44 from the cam 42.

The third function the pulley 62 provides is a surface to attach a flag mechanism which in turn provides angular position information to a controller. The operation of the flag mechanism 86 is more easily illustrated in FIGS. 5 and 7. A photocell 82 mounted by a bracket 81 onto a housing of the motor 60 operates in conjunction with a shroud member 84, referred to as a flag, mounted on the pulley 62 for rotation therewith to sense a revolution of pulley 62. The photocell 82 comprises a spaced apart emitter and sensor disposed in U-shaped fashion relative to the flag 84 such that an outer portion **84*a* of the flag 84 obstructs the line of site between the emitter and the sensor as the flag rotates past the photocell 82. In the embodiment shown, the photocell 82 is mounted to point directly at the center of the pulley 62. The photocell 82 senses the angular position of the flag 84. When the flag 84 is in line with photocell 82, the photocell 82 detects the flag 84. To begin rotation, the motor 60 receives a signal from a controller, the pulley 62 rotates the flag 84 from the line of sight of the photocell 82 and the pulley 62 makes one rotation until the flag 84 passes through the line of sight of photocell 82 thus signalling the controller to stop motor 60. The motor 60 then coasts to a stop after about 45 degrees of rotation as is generally illustrated in FIG. 5. An alternative embodiment may utilize an alternative switch mechanism such as a microswitch and a cam projection on the pulley 62 for informing the controller when to stop the motor 60**.

Figure 7:
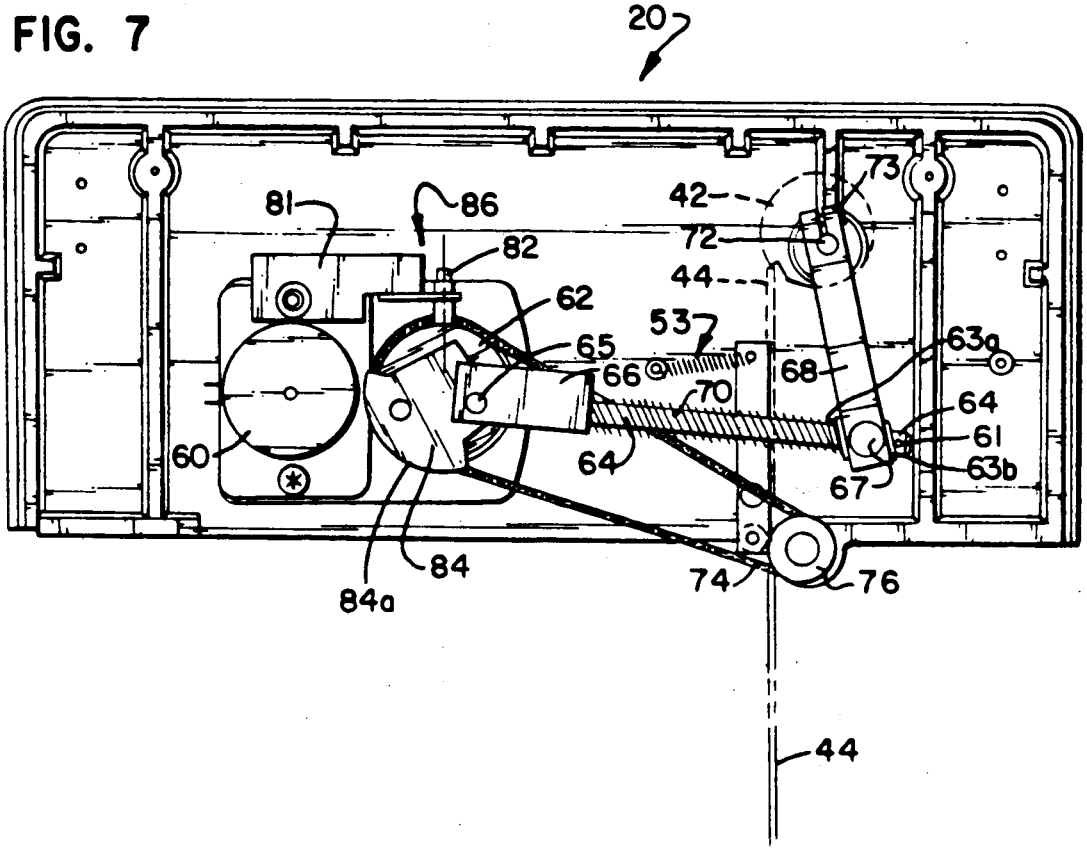
FIG. 7 is a bottom plan view of the bottom of the input hopper apparatus in its card feeding position as shown in FIG. 4.
Figure 8:
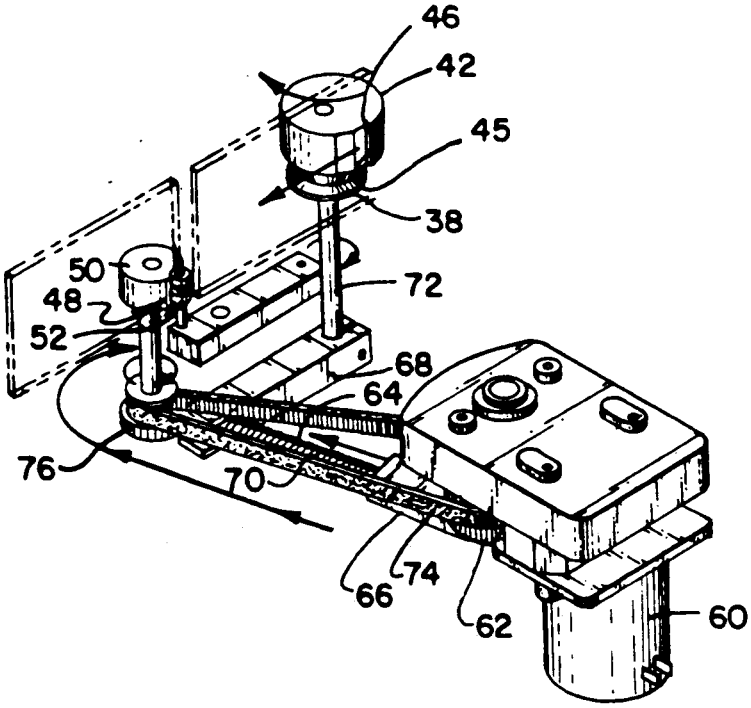
FIG. 8 is a partial perspective view of the input hopper apparatus shown in FIG. 2 with elements removed for purposes of illustration.

This operation may be more easily understood by comparing FIGS. 5 and 7. An input hopper cycle begins with a command signal to start motor rotation. At this point in time the flag 84 blocks the photocell 82. FIG. 5 illustrates flag 84 in line of photocell 82. As the pulley 62 begins to rotate, the flag 84 is out of line of the photocell 82 as shown in FIG. 7. The flag 84 then makes a complete rotation until the flag 84 again blocks photocell 82. When this occurs, the photocell 82 sends a signal to motor 60 indicating it to stop rotation. The motor 60 then stops, and the pulley 62 coasts approximately 45 degrees to a stop. One motor revolution will pick and transfer a card. The cam 42 will move toward the edge of the leading card as the pulley 62 rotates. The card is sheared from the stack of cards and pushed toward the main roller 50. Further rotation of the pulley 62 forces the card into the nip between the main roller 50 and the pinch roller where the card is gripped by the force of the pinch roller. At this point, about one-third of a pulley 62 revolution has passed. The remaining rotation of the pulley 62 transfers the card from the input hopper apparatus 20 into the card processing system and returns the picking cam 42 to the normal rest position for the next card picking cycle.

The present invention saves considerable time and money in repairs of an input hopper apparatus. It is to be understood that even though numerous characteristics and advantages of the present invention have been set forth in the foregoing description, together with details of the structure and function of the invention, the disclosure is illustrative only and changes may be made in detail especially in matters of input hopper working elements and their operation and supporting hardware to the full extent indicated by the broad general meaning of the terms in which the appended claims are expressed.

What is claimed is:

1. An input hopper apparatus used with card members, the apparatus comprising:

(a) stacking means having a front end and a rear end for storing the card members in stacked configuration, the card members each having opposing facing major surfaces and a top, bottom, first, and second side edge, the card members resting on their bottom edges in the stacking means;

(b) biasing means for biasing the card members toward the front end of the stacking means;

(c) card picker means for separation of a lead card member proximate the front end of the stacking means, wherein a roller assembly proximate the first side edge of the lead card provides frictional force to the lead card member, thus propelling the card member from the input hopper, and wherein the roller assembly comprises a drive roller, a pinch roller and an index roller, the drive roller providing frictional shear force to the lead card member;

(d) a motor;

(e) drive linkage means intermounting the motor to the card picker means, wherein the drive linkage includes a drive pulley connecting to an elongated shaft, the elongated shaft being slidably intermounted to an extension arm of the drive linkage; and, (f) shear force override means comprising a compressed spring positioned about the elongated shaft between the drive pulley and the extension arm, wherein the spring is continually compressed to drive the extension arm during a drive stroke.

2. An apparatus according to claim 1, further comprising a stop at the end of the elongated shaft preventing the compressed spring from forcing the extension arm off the end of the elongated shaft.

* * * * *